United States Patent [19]

Piosky

[11] 4,057,898

[45] Nov. 15, 1977

[54] REPAIR TEMPLATE FOR CARPETS OR THE LIKE

[76] Inventor: Dennis E. Piosky, 416 Scranton Ave., Lynbrook, N.Y. 11563

[21] Appl. No.: 714,494

[22] Filed: Aug. 16, 1976

[51] Int. Cl.[2] ..... B26B 11/00; B26B 29/02

[52] U.S. Cl. ..... 30/289; 33/174 B

[58] Field of Search ..... 30/286, 289, 130, 282, 30/288, 123; 33/174 B, 174 G

[56] References Cited

U.S. PATENT DOCUMENTS

| | | | |
|---|---|---|---|
| 2,559,434 | 7/1951 | Hyland | 33/174 B X |
| 3,037,293 | 6/1962 | Yost | 33/174 B |
| 3,171,200 | 3/1965 | Poppenga | 30/130 |
| D. 137,150 | 1/1944 | Riddell | 33/174 B X |

*Primary Examiner*—Jimmy C. Peters

*Attorney, Agent, or Firm*—Bauer, Amer & King

[57] ABSTRACT

As a means for effectively dealing with a carpet damage, such as a cigarette burn, a cutting template is provided which produces standardized sized cut-outs. Thus, use of the within template contemplates removing the cigarette burn within a removal cut-out and, in an out-of-the-way area, such as under a furniture piece, obtaining a replacement cut-out which, being of the exact same size and shape is readily inserted in place within the carpet opening previously occupied by the removal cut-out.

5 Claims, 6 Drawing Figures

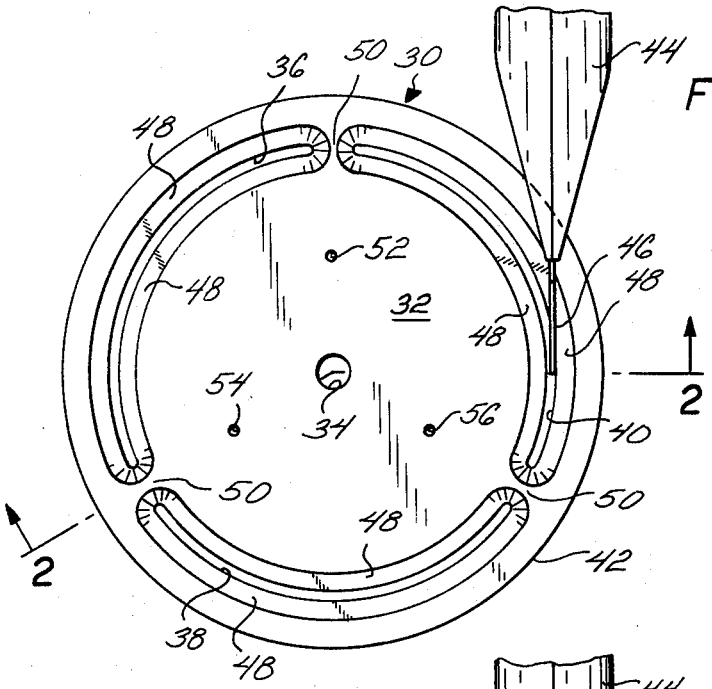
FIG. 1
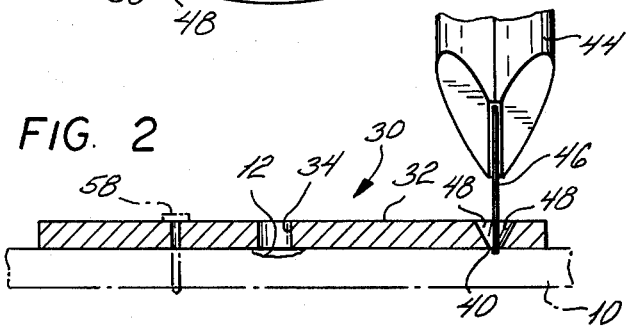
FIG. 2
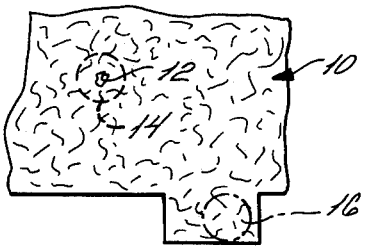
FIG. 5
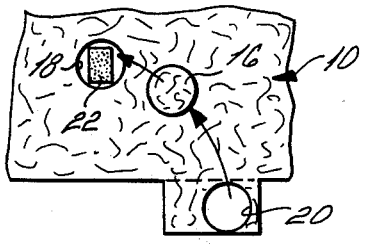
FIG. 6
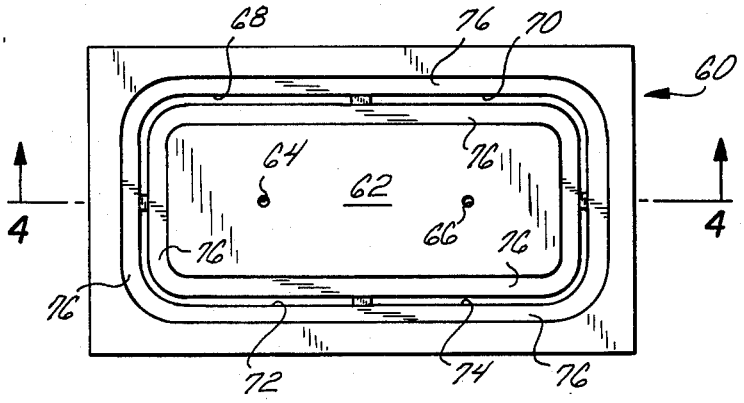
FIG. 3
FIG. 4
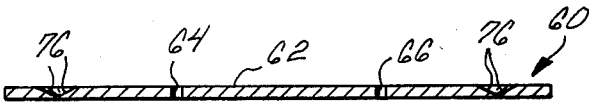

REPAIR TEMPLATE FOR CARPETS OR THE LIKE

The present invention relates generally to carpet or other floor and wall covering repairs, in which the unsightliness of a damage therein, such as a cigarette burn, is effectively eliminated, and more particularly to a template and method of using same to achieve the aforesaid elimination of unsightly surface damages in a carpet or the like.

The removal of a carpet cigarette burn and reweaving of the removed area entails expense and effort which are obvious drawbacks. Underlying the present invention is the recognition that removal of the cigarette burn within a cut-out controlled as to size will readily permit an undetectable substitution using a similarly sized cut-out, particularly if the carpet has a pile surface in which the individual fibers assist in effectively masking the outline of the replacement cut-out. Said replacement cut-out naturally is to be obtained from a non-visibly prominent area of the carpet, or even from an unused supply length or panel thereof.

Unlike known templates, the inventive template hereof is used for cutting, rather than merely drawing or tracing, a standardized shape, and said standardized shape, as already noted, is used to promote interchangeability between two in number of such shapes produced during cutting service use of the template in the elimination of carpet surface imperfections. Heretofore, templates were restricted to a drafting function, and were not useful in making carpet repairs of the nature indicated.

Broadly, it is an object of the present invention to provide a cutting template, as well as a noteworthy method of using same, overcoming the foregoing and other shortcomings of the prior art. Specifically, it is an object to obviate the expense and tedious effort heretofore required in the making of a carpet repair by the simple use of a cutting template in the manner hereinafter described.

A carpet repair template demonstrating objects and advantages of the present invention comprises a circular body sized to extend in covering relation over the carpet cigarette burn or similar damage, and has three circumferentially spaced arcuate shaped knife-guiding grooves located about its periphery which, because of their location, occupy a position in surrounding relation to the carpet cigarette burn when the template is placed in superposed position over the burn. Thus, the template enables the removal of the burn within a circular removal cut-out from the carpet which is size-dictated by the knife-guiding grooves. Further use of the template contemplates it being operatively positioned in cutting relation to a selected carpet area of minimal visibility, such as under a couch, for obtaining a similarly sized circular replacement cut-out using the knife-guiding grooves thereof. As a result, there is obtained a replacement cut-out which is readily inserted in place in the opening previously occupied by the removal cut-out.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a plan view of the repair template hereof illustrating the cutting knife being used in connection therewith;

FIG. 2 is a side elevational view, in section taken along line 2—2 of FIG. 1 showing further structural details and in which a carpet is illustrated in underlying relation to the repair template;

FIG. 3 is a plan view of another shape of the repair template according to the present invention;

FIG. 4 is a side elevational view, in section taken along line 4—4 of FIG. 3, showing further structural details;

FIGS. 5 and 6 are partial plan views illustrating the contemplated manner of using the within repair template. Specifically, FIG. 5 illustrates a carpet and in phantom line perspective illustrates contemplated carpet removal and replacement cut-outs, all as will be subsequently explained herein; and FIG. 6 illustrates how a replacement cut-out is inserted in a carpet opening previously occupied by the carpet removal cut-out.

Reference is now made to the drawings and in particular to FIGS. 5 and 6 which, as noted just above, illustrate the manner of using the repair template of the present invention. More particularly, let it be assumed that carpet 10 has a visibly prominent cigarette burn 12 or other such damage which it is desirable to remove. In a manner which will be subsequently described, this is done by actually cutting from the body of the carpet 10 the removal cut-out 14, of the size and shape indicated and which, as also indicated, includes the damage 12 in a central location. In a separate operation, the repair template hereof, again as will be subsequently explained, is also utilized to remove a replacement cut-out 16 which significantly has the same shape and size as the cut-out 14, the reason being of course that the repair template hereof is used to produce both of the cut-outs 14 and 16.

As is perhaps best shown in FIG. 6, to which reference is made, upon the removal of the cut-out 14, this of necessity produces an opening 18 in the carpet 10 of the shape and size illustrated, opening 18 of course being previously occupied by the removed cut-out 14 which included the damage 12. Thereafter, and as clearly illustrated in FIG. 6, the replacement cut-out 16 is readily moved from its previous location 20 and inserted in place within the opening 18, the size and shapes thereof having the necessary compatibility to achieve this. To assist in holding the replacement cut-out 16 in place, use may be made of an adhesive hold-down strip 22. Still referring to FIG. 6, it should be noted that the location 20 selected for producing the replacement cut-out 16 is one which either under a couch or other piece of furniture or otherwise is not prominently visible, so that failure to replace the opening 20 with any carpet material does not detract from the appearance of carpet 10. Alternatively, the user may have an unused or supply piece of carpet 10 which, of course, can be ideally used as a source for the replacement cut-out 16.

To utilize the repair template according to the present invention for the production of the removal and replacement cut-outs 14, 16, respectively, said template, generally designated 30 in FIGS. 1, 2, to which reference is now made, includes a circular body 32, preferably fabricated of metal, such as a high quality machine steel. This construction material readily permits fabricating body 32 with structural features now to be described. One structural feature is a centrally located sighting opening 34 through which the user sights the damage 12 when placing the template 30 in its operative position, as illustrated in FIG. 5, over the damage 12 preparatory to the production of the removal cut-out 14. With the damage 12 visible through the opening 34, the user has assurance that the arcuate shaped knife-guiding grooves, of which there are three designated 36, 38 and 40, occupy positions in surrounding relation to the damage 12. As illustrated, the grooves 36, 38 and 40 generally follow the circular contour of the peripheral edge 42 of the template body 32 and are in adjacent position thereto.

Consistent with its intended use of enabling the cut-out removal of a carpet area, each groove is identically constructed to facilitate guiding a knife, and more particularly the cutting blade 46 extending therefrom, along a path dictated by the arcuate shape and size of each groove 36, 38 and 40. In this regard, each groove is machined to have bevelled or angularly oriented sides 48 which converge toward and terminate in edges which bound each of the grooves. This is best shown in FIG. 2 which illustrates groove 40 in cross-section.

To embody the knife-guiding grooves actually within the body 32, rather than to merely present knife-guiding peripheral edges about the body, it is of course necessary that the medial portion of the body, which is on one side of the grooves, be connected to the peripheral portion located on the opposite side. Thus, body 32 includes connecting body sections 50, each strategically located between adjacent grooves. Sections 50 preferably do not produce an interruption between adjacent cutting grooves of more than one-quarter inch, and this in practice has been found not to seriously affect providing uniform and standardized dimensions and shapes to the removal and replacement cut-outs 14, 16, respectively, so that the latter is readily interchanged with the former, all as has been described in connection with FIGS. 5 and 6.

Although not required, to assist in holding the template body 32 down firmly against the surface of the carpet 10 and thus to provide the template 30 with its operative position as illustrated in FIG. 2, body 32 is provided with additional nail openings 52, 54 and 56 which, in practice, each accommodates a nail 58 therethrough which holds down the template and which also incidentally prevents any inadvertent rotative movement thereof while the knife 44 is being moved through arcuate movement using the guiding grooves 36, 38 and 40. Without the nails 52, 54 and 56, there is a tendency for the template 30 to rotate when the knife blade 46 abuts against the surface defining the end of each of the guiding grooves. However, if necessary, the template 30 can be physically held by the user against this rotation or, as just indicated, one or more of the nails 52, 54 and 56 can be used for this purpose.

The repair template 30 hereof has been described particularly in connection with repairing a carpet since this is its primary intended end use. However, it should be readily apparent that the repair template 30 can also be used in connection with other floor coverings such as linoleum, and even for wall covering such as wallpaper. Thus, the use in this description and also in the appended claims of the word "carpet" is not intended to limit or restrict the scope of the invention as defined in the claims and, in particular, it is to be understood that the repair template 30 can also be advantageously used in providing a removal and replacement cut-out for all types of materials used for floor and wall coverings.

When used for repairing wallpaper, however, it has been found that modification of some of the structural features and aspects of the template make it easier to use with this type of material. Specifically, since the wallpaper is on a support surface which is vertically oriented, rather than horizontally oriented, it is advisable to cut down on the mass and weight of the template. Accordingly, a wallpaper template in accordance with the present invention would embody the structural features shown in FIGS. 3, 4, to which reference is now made. As illustrated therein, the template 60 has a rectangularly shaped body 62 of a significantly reduced thickness which of course substantially cuts down on the weight of the item. Due to the increased size which is provided the template 60 because of its rectangular shape, the centrally located sighting opening can be dispensed with since there is very little difficulty in assuring that the template 60 will cover and extend beyond the damaged area which is intended to be replaced in the wallpaper. It is however advisable to provide wallpaper template embodiment 60 with nail openings 64 and 66 to hold the template 60 in place during the production of the removal and replacement cut-outs.

Completing the wallpaper template 60 are four knife-guiding grooves 68, 70, 72 and 74, each of which extends throughout one of the corners of the rectangular area which is prepared for removal in the wallpaper. During the machining of the grooves just identified the walls 76 thereof are angularly oriented to facilitate placement of the knife blade 46 therein, and also to enable the user to better observe the separation of the cut-out from the main body of the wallpaper or similar material.

From the foregoing description it should be readily appreciated that there has been described herein a repair template useful for repairing floor and wall coverings, the former being particularly exemplified by template 30 intended for use with carpets, which template is characterized by an exceedingly simple construction and a novel use in that it prepares removal and replacement cut-outs, such as cut-outs 14 and 16, which are interchangeable because of their standardized size and shape provided by use of the template 30. Thus, the unsightliness which otherwise would result from a carpet damage, which typically would be a cigarette burn 12 in a visibly prominent area of the carpet, is effectively eliminated by placement of the replacement cut-out 16 in the opening 18 sized or dimensioned to precisely accommodate this cut-out and which as a result avoids any telltale traces of the existence of the replacement cut-out.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. A template for repair of a carpet or the like that is used by dimensioning a replacement cut-out from said carpet material for a visibly damaged area in said carpet of a comparatively small size, said template comprising a body sized to extend in covering relation over said damaged area and having an operative position in superposed relation thereto, said body having a positioning opening therein through which said damaged area is sighted during the placement of said template in said operative position, and an arrangement of disconnected knife-guiding grooves located in said body in surrounding relation to said positioning opening to enable the removal of said damaged area within a carpet removal cut-out having a shape and size dictated by said knife-guiding grooves, said grooves having beveled sides which converge toward and terminate in edges bounding each of said knife-guiding grooves to precisely shape and size said carpet removal and replacement cut-outs, said shaped and sized carpet removal cut-out providing a correspondingly shaped and sized opening in said carpet, said template being adapted to be operatively positioned in cutting relation to a selected carpet area of minimal visibility for obtaining a replacement cut-out using said knife-guiding grooves thereof, whereby said replacement cut-out is dimensioned so as to be readily inserted in place in said opening previously occupied by said removal cut-out.

2. A repair template for carpets or the like as claimed in claim 1 wherein said knife-guiding grooves are spaced inwardly adjacent and follow the contour of the periphery of said template body.

3. A repair template for carpets or the like as claimed in claim 2 wherein said template body is circular and said knife-guiding grooves are arcuate and in circumferentially spaced relation to each other.

4. A repair template for carpets or the like as claimed in claim 2 wherein said template body is rectangular and there are four knife-guiding grooves therein, each extending throughout a corner of said rectangular shaped body.

5. A repair template for carpets or the like as claimed in claim 3 including additional openings in said body between said positioning opening and said knife-guiding grooves adapted to receive therethrough nails to hold down said template against said carpet and to prevent rotative movement thereof during use.

* * * * *